US007613411B2

(12) United States Patent
Tateishi et al.

(10) Patent No.: US 7,613,411 B2
(45) Date of Patent: Nov. 3, 2009

(54) FUSER UNIT AND IMAGING FORMING APPARATUS HAVING THE SAME

(75) Inventors: Yoshinobu Tateishi, Nara (JP); Toyoaki Nanba, Osaka (JP); Hiroaki Hori, Kyoto (JP); Toshiaki Kagawa, Nara (JP); Tetsunori Mitsuoka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 180 days.

(21) Appl. No.: 11/762,791

(22) Filed: Jun. 14, 2007

(65) Prior Publication Data

US 2007/0297826 A1 Dec. 27, 2007

(30) Foreign Application Priority Data

Jun. 22, 2006 (JP) ..... 2006-172927

(51) Int. Cl.
*G03G 15/20* (2006.01)

(52) U.S. Cl. ..... 399/69; 399/43; 399/330; 399/335

(58) Field of Classification Search ..... 399/33, 399/43, 67, 69, 320, 330, 335, 336
See application file for complete search history.

(56) References Cited

U.S. PATENT DOCUMENTS 5,918,087 A * 6/1999 Kimura et al. ..... 399/69
6,411,785 B1 * 6/2002 Ogawahara et al. ..... 399/69

FOREIGN PATENT DOCUMENTS

| | | |
|---|---|---|
| JP | 2002-182503 | 6/2002 |
| JP | 2003-233274 | 8/2003 |
| JP | 2004-085601 | 3/2004 |
| JP | 2004-198659 | 7/2004 |

* cited by examiner

*Primary Examiner*—Stephen F Husar
(74) *Attorney, Agent, or Firm*—Renner, Otto, Boisselle & Sklar, LLP

(57) ABSTRACT

A fuser unit including: a set of a heat roller and a pressure roller for sandwiching and conveying a printing sheet while heating the printing sheet by the heat roller; a peripheral surface contact member which is in contact with the peripheral surface of the heat roller; an external heater for heating the peripheral surface contact member by applying electric energy; a contact member temperature sensor for detecting a temperature of the peripheral surface contact member; and a temperature controller for controlling an upper limit temperature of the peripheral surface contact member in accordance with the number of printing sheets conveyed per unit time.

9 Claims, 5 Drawing Sheets

FUSER UNIT AND IMAGING FORMING APPARATUS HAVING THE SAME

CROSS-REFERENCE TO RELATED APPLICATION

This application is related to Japanese application No. 2006-172927 filed on Jun. 22, 2006 whose priority is claimed under 35 USC §119, the disclosure of which is incorporated by reference in its entirety.

BACKGROUND OF THE INVENTION

1. Field of the Invention

The present invention relates to a fuser unit having an external heating member for heating a surface of a heat roller and to an image forming apparatus having the same.

2. Description of the Related Art

In recent years, a printing speed of a color image forming apparatus has been increasing. In the current state, however, the color printing speed has not reached a printing speed of a so-called high-speed monochrome image forming apparatus. A process of forming a color image is more complicated than that of forming a monochrome image. Moreover, without achieving high-level picture quality determining elements of hue, color shift, and the like which are not related to monochrome printing, the color image forming apparatus cannot be accepted by the markets. On the other hand, the monochrome image forming apparatus is requested to achieve a higher processing speed.

There is a known color image forming apparatus having printing speeds that vary between a formation of a monochrome image (monochrome printing mode) and a formation of a color image (color printing mode) in order to satisfy both picture quality of the color printing and high speed of the monochrome printing. In this case, travel speeds of a photoconductor for forming an image, that is, process speeds may vary according to the printing modes. Obviously, the process speed for forming an image in the monochrome printing mode is higher than that in the color printing mode.

In a fuser unit in such an image forming apparatus, a rate of decrease in a surface temperature of a fuser roller (heat roller) depends on the number of printing sheets passing in unit time for a reason that heat is taken from a surface of the heat roller by the printing sheets passing through the heat roller. If the amount of heat supplied from a heater to the surface of the heat roller cannot overtake the amount of the heat taken by the printing sheets, the surface temperature of the heat roller gradually drops. When the surface temperature drops below an allowable range, the fix level of a toner insufficiently decreases, and the requested picture quality and fixing performance cannot be obtained. The heat supply time per sheet of the apparatus having the higher printing speed is shorter than that of the apparatus having the lower printing speed. During the time, the amount of the heat taken from the heat roller has to be recovered. Further, the process speed of the apparatus having the high printing speed is higher than that of the apparatus having the low printing speed. That is, the time in which the printing sheet passes through a nip portion is shorter in the apparatus having the higher printing speed. The toner transferred on the printing sheet has to be dissolved in the short time and an amount of the heat for fusing the toner on the printing sheet has to be supplied to the printing sheet and the toner on the printing sheet.

As described above, the apparatus having the high printing speed needs to supply a larger amount of the heat to the surface of the heat roller within limited time and further supply to the printing sheet and the toner via the surface of the heat roller. Consequently, a control temperature of the heater has to be increased and a temperature difference between a heat supply source and a part to which the heat is supplied (the printing sheet and the toner) has to be increased. The heater for supplying the heat to the surface of the heat roller is generally provided in the heat roller. Radiation heat from the heater conducts through a cored tube in the heat roller and an elastic layer around the cored tube and reaches the surface. In this case, a temperature in the heat roller is higher than that of the surface. When the control temperature of the heater is set too high, the inside of the elastic layer is damaged by the heat.

Therefore, an apparatus using an external heating unit is known, in which the temperature in the heat roller does not increase too high and the heat of the surface taken by the printing sheet is promptly supplied (for example, refer to Japanese Unexamined Patent Publication No. 2004-85601 and 2004-198659).

In the fuser unit having the external heating unit, it is desirable to increase the control temperature of the heater in the external heating unit to promptly supply the heat in order to respond to the higher printing speed. However, there is an upper limit for the control temperature of the external heating unit. When the temperature is set too high, the external heating unit is damaged by the heat.

In the image forming apparatus which has the printing modes and in which the printing speeds vary according to the printing modes, the upper limit temperature of the external heating unit needs to be set so that the apparatus can respond to the monochrome printing mode in which the printing speed is high. In this case, an unnecessary amount of the heat is supplied to the external heating unit in the color printing mode in which the printing speed of the color printing mode is lower than that of the monochrome printing mode. As a result, there is the possibility that deterioration caused by the heat in the external heating unit may unnecessarily occur. In particular, this phenomenon is conspicuous in a use environment in which a ratio of the color printing mode is higher than that of the monochrome printing mode.

In the image forming apparatus having a plurality of printing speeds, a method is desired, of which the deterioration in the external heating unit in low-speed printing is suppressed by properly controlling a supply of the heat to the external heating unit.

SUMMARY OF THE INVENTION

The present invention provides a fuser unit including: a set of a heat roller and a pressure roller for sandwiching and conveying a printing sheet while heating the printing sheet by the heat roller; a peripheral surface contact member which is in contact with the peripheral surface of the heat roller; an external heater for heating the peripheral surface contact member by applying electric energy; a contact member temperature sensor for detecting a temperature of the peripheral surface contact member; and a temperature controller for controlling an upper limit temperature of the peripheral surface contact member in accordance with the number of printing sheets conveyed per unit time.

The present invention further provides an image forming apparatus including the aforementioned fuser, wherein printing is performed selectively in either a color printing mode or a monochrome printing mode, the number of sheets printed per unit time in the color printing mode and that in the monochrome printing mode are different from each other, and the temperature controller controls an upper limit temperature of the peripheral surface contact member in accordance with the selected printing mode.

Since the fuser unit of the present invention includes a temperature controller for controlling an upper limit temperature of a peripheral surface contact member (external heating unit) in accordance with the number of printing sheets conveyed per unit time, a supply of heat to the peripheral surface contact member can be properly controlled. Therefore, when the number of the printing sheets is small, deterioration in the peripheral surface contact member can be suppressed.

The peripheral surface contact member may include a plurality of rollers and an endless belt looped over the rollers, and the endless belt may be disposed so that a portion between the rollers is in contact with the heat roller.

Further, the external heater may heat the roller positioned on the upstream side from the portion of the endless belt in contact with the heat roller to supply heat via the heated roller to a surface of the endless belt.

The contact member temperature sensor may detect a surface temperature of the endless belt.

The contact member temperature sensor may be disposed to abut on the endless belt around the peripheral surface of the roller heated by the external heater.

In the image forming apparatus of the invention, the number of printing sheets per unit time in a color printing mode and that in a monochrome printing mode are different from each other, and the temperature controller controls the upper limit temperature of the peripheral surface contact member in accordance with a selected printing mode, so that the supply of the heat to the peripheral surface contact member can be properly controlled. Therefore, when the number of printing sheets is small, deterioration in the peripheral surface contact member can be suppressed.

The number of sheets printed per unit time in the monochrome printing mode may be larger than that in the color printing mode The upper limit temperature in the monochrome printing mode may be higher than that in the color printing mode.

The image forming apparatus may further includes: an internal heater disposed in the heat roller; and a fusing temperature sensor for detecting a surface temperature of the heat roller, wherein the temperature controller further may control electric energy applied to the internal heater so that a temperature detected by the fusing temperature sensor is set at a predetermined fusing control temperature.

Further, the fusing control temperature in the color printing mode and that in the monochrome printing mode may be equal to each other.

Alternately, the fusing control temperature may be lower than the upper limit temperature in the monochrome printing mode and be also lower than the upper limit temperature in the color printing mode.

DETAILED DESCRIPTION OF THE PREFERRED EMBODIMENTS

The present invention will be described in detail below with reference to the drawings. From the following description, the invention can be further understood. The following description is considered to be illustrative and not restrictive in all of aspects.

Configuration of Fusing Unit

Figure 1:
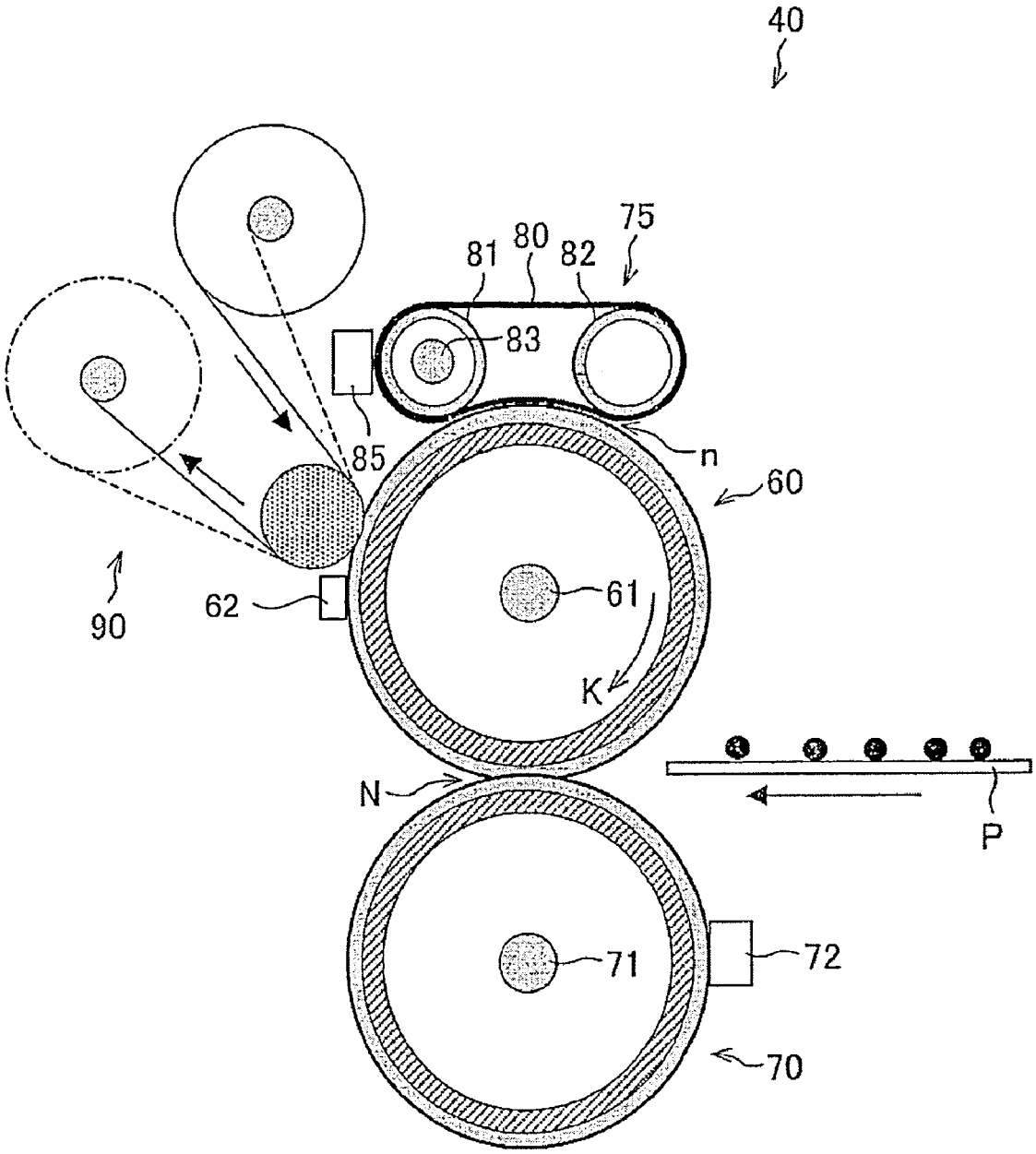
FIG. 1 is a diagram showing a sectional configuration of a fuser unit 40 as an embodiment of the present invention.

First, the configuration of a fuser unit 40 will be described. FIG. 1 is a diagram showing a sectional configuration of the fuser unit 40 as an embodiment of the invention. As shown in FIG. 1, the fuser unit 40 has, in addition to a heat roller 60 and a pressure roller 70 described above, an external heating unit 75 and a web cleaning unit 90. The external heating unit 75 corresponds to the above-described external heating unit.

The heat roller 60 and the pressure roller 70 are in pressure contact with each other with a predetermined load (in this case, 600N), and a nip portion N (the portion of the contact between the heat roller 60 and the pressure roller 70) is formed in the pressure contact portion between the two rollers. In the embodiment, the nip width of the nip portion N (the width along a rotation direction of the heat roller 60 (a direction K in FIG. 1)) is set to about 9 mm.

The heat roller 60 is heated to a predetermined temperature (hereinbelow, corresponding to the fusing control temperature in the claims) and heats an unfused toner image transferred on a surface of a sheet (printing sheet) P passing through the nip portion N. In the embodiment, the fusing control temperature of the heat controller is 180° C. The heat roller 60 has an elastic layer on a peripheral surface of a cored tube, and is a roller member having a three-layer structure in which a mold-release layer is formed on a peripheral surface of the elastic layer.

For the cored tube, for example, a metal such as iron, stainless steel, aluminum, copper, or the like or an alloy of the metal is used. For the elastic layer, silicon rubber is used. For the mold-release layer, a fluororesin such as PFA (a copolymer of tetrafluoroethylene and perfluoroalkylvinylether) and PTFE (polytetrafluoroethylene) is used.

In the heat roller 60 (in the cored tube), a heater lamp (halogen lamp) 61 as a heat source for heating the heat roller 60 is disposed. The heater lamp 61 corresponds to the internal heater in the claims. The heater lamp 61 is connected to an AC power source via a not-shown switch device. The switch device turns on/off a power supply to the heater lamp 61. Concretely, a power semiconductor device such as a triac can be applied. An on/off operation of the switch device is controlled by a not-shown controller (corresponding to the temperature controller in the claims). When the switch device is turned on and power is supplied to the heater lamp 61, the heater lamp 61 emits infrared light. The emitted infrared light is absorbed by an inner peripheral surface of the heat roller 60, thereby heating the whole heat roller 60. Therefore, a surface of the heat roller 60 is also heated.

A function of the controller may be realized when a control program stored in a nonvolatile memory device is executed by a microcomputer. The controller may control operations of not only the fuser unit but also parts of an image forming apparatus 1 which will be described later. A method of realizing a function by hardware, not using the microcomputer, is also possible.

The pressure roller 70 is pressed against the heat roller 60 by a press contact mechanism (not shown) provided at an end side of the pressure roller 70 and applies a predetermined pressure to the nip portion N. The pressure roller 70 has, like the heat roller 60, an elastic layer made of silicon rubber or the like on the peripheral surface of the cored tube made of any metals such as iron, stainless steal, aluminum, copper, and the like or alloys of the metals, and further is a roller member having a three-layer structure in which a mold-release layer made of PFA (perfluoroalkoxy) resin, PTFE (polytetrafluoroethylene) resin, or the like is formed on the peripheral layer of the elastic layer.

In the embodiment, a heater lamp 71 is provided on the inside of the cored tube in the pressure roller 70. The heater lamp 71 controls electric energy by the controller (not shown). When the heater lamp 71 is turned on, it emits infrared light. The emitted infrared light is absorbed by an inner peripheral surface of the pressure roller 70, and the whole pressure roller 70 is heated.

The external heating unit 75 has an endless external heating belt (belt member) 80 and external heat rollers (heating members) 81 and 82 as a pair of belt looping rollers over which the external heating belt 80 is looped. The external heating belt 80 is the endless belt, that is, the peripheral surface contact member in the claims.

The external heating belt 80 in a state where it is heated to a predetermined temperature is in contact with the surface of the heat roller 60 to heat the surface of the heat roller 60. As will be described later, heat is supplied via the external heat roller 81 which is in contact with the back side to the external heating belt 80.

The external heating belt 80 is disposed on the upstream side of the rotation direction (the direction K in FIG. 1) of the heat roller 60 more than the nip portion N around the heat roller 60, and is pressed against the heat roller 60 with a predetermined press force (40N in this case) by a press contact mechanism which will be described later. A heating nip portion "n" is formed between the external heating belt 80 and the heat roller 60. In the embodiment, the nip width (the width along the rotation direction of the heat roller 60) of the heating nip portion "n" is approximately 20 mm.

The external heating belt 80 is an endless belt having a two-layer configuration in which a mold-release layer is formed of a synthetic resin material (fluororesin such as PFA or PTFE) having excellent heat resistance and releasability on a surface of a hollow cylindrical belt base made of a heat-resisting resin such as polyimide or a metal material such as stainless steel or nickel. To reduce a twist force of the external heating belt 80, an inner surface of the belt base may be coated with a fluororesin or the like.

Although the external heating belt 80 is heated to a temperature at which heat can be supplied to the heat roller 60, when it is heated too much, a function of the external heating belt 80 is damaged. When a temperature of the heating nip portion "n" is too high, the heat roller 60 is also damaged. Therefore, it is desirable to maintain a surface temperature of the external heating belt 80 to a predetermined temperature or less.

The external heat rollers 81 and 82 take the form of hollow cylindrical metal cores made of aluminum, an iron-based material, or the like. To reduce the twist force of the external heating belt 80, surfaces of the metal cores may be coated with fluororesin or the like.

A heater lamp 83 as a heat source is disposed on the inside of the external heat roller 81. The heater lamp 83 is the external heater in the claims. When the heater lamp 83 is turned on by the controller (not shown), the heater lamp 83 emits infrared light. The emitted infrared light is absorbed by an inner peripheral surface of the external heat roller 81 and, accordingly, the whole external heat roller 81 is heated. Further, by heat conduction, the external heating belt 80 looped over the external heat roller 81 is also heated.

A thermister 62 as temperature detecting means is disposed on a peripheral surface of the heat roller 60, and a thermister 72 is disposed on a peripheral surface of the pressure roller 70. On a surface side of the external heating belt 80, a thermister 85 is disposed in a position facing the external heat roller 81. The thermister 62 corresponds to the fusing temperature sensor in the claims. The thermister 85 corresponds to the contact member temperature sensor in the claims. Each of the thermisters 62, 72, and 85 is a contact type but may be a non-contact type.

On the basis of outputs of the thermisters 62, 72, and 85, the controller (not shown) calculates surface temperatures in two positions out of the heat roller 60, the pressure roller 70, and the external heating belt 80, and controls the electric energy applied to the corresponding heater lamps 61, 71, and 83 so that the calculated surface temperatures reach closer to target temperatures. The details of the control will be described later.

In the embodiment, the electric energy applied to the heater lamps 61, 71, and 83 is controlled by the controller in the image forming apparatus 1 which will be described later in the embodiment. Alternatively, the fuser unit 40 may have an independent controller.

Although it is not shown in FIG. 1, a driving force from a drive motor (drive source) is transmitted to a rotary shaft provided at the end of the heat roller 60, and the rotary shaft is rotated in the direction K in FIG. 1. When the heat roller 60 is rotated in fusing operation and the like, the pressure roller 70 which is in press-contact with the heat roller 60 is driven by a frictional force. Consequently, a rotating direction of the pressure roller 70 is opposite to the direction K.

The external heating belt 80 in the external heating unit 75 is also driven by the heat roller 60 by the frictional force in the part of contact with the heat roller 60. Therefore, the rotating direction of the external heating belt 80 is opposite to the direction K. Surfaces of the external heat rollers 81 and 82 are in contact with a rear surface of the external heating belt 80, so that the external heat rollers 81 and 82 are driven by the external heating belt 80.

The sheet P is conveyed in the nip portion N so that its toner image formation surface comes into contact with the heat roller 60 and its rear surface comes into contact with the pressure roller 70. The toner image formed on the sheet P undergoes thermal compression and is fixed on the sheet P. Fusing speed as passing speed in the nip portion N of the sheet P is the same as transfer speed of a conveyance belt 33, that is, sheet conveyance speed. In the embodiment, the sheet conveyance speed in the color printing mode is 225 mm/second, and that in the monochrome printing mode is 350 mm/second.

Figure 3B:
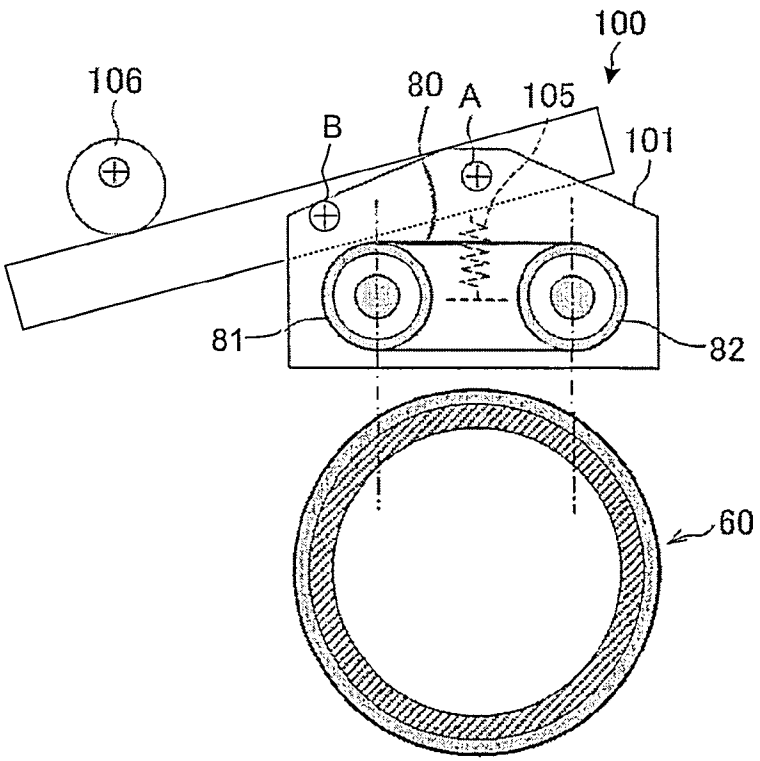
FIGS. 3A and 3B are diagrams illustrating another mode of the fuser unit of the invention, as an example in which an external heating unit 75 has an attaching/detaching mechanism.
Figure 3A:
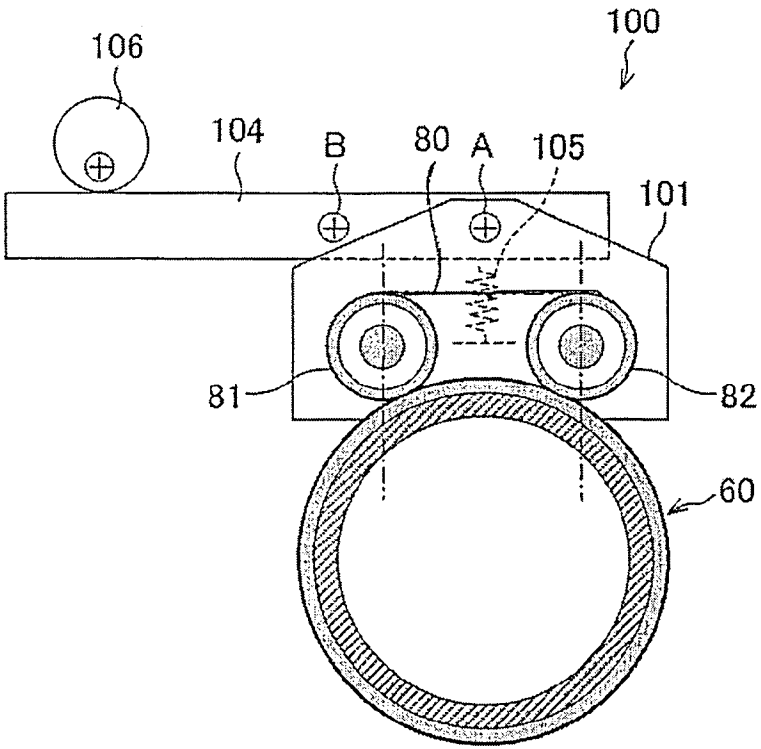

The external heating unit 75 may have an attaching/detaching mechanism for making the external heating belt 80 attached/detached to/from the surface of the heat roller 60. FIGS. 3A and 3B are diagrams illustrating another mode of the fuser unit of the invention, as an example in which the external heating unit 75 has an attaching/detaching mechanism. As shown in FIGS. 3A and 3B, the external heat rollers 81 and 82 and the external heating belt 80 are formed in an integral unit and swingably attached to an arm 104 via an axis A. The arm 104 is turnably supported by an axis B. Further, a spring 105 is attached near the axis A of the arm 104 and energizes the arm 104 so that the external heating belt 80 comes into contact with the surface of the heat roller 60. On the side opposite to the arm 104 via the axis B, an eccentric cam 106 is provided. The peripheral surface of the eccentric cam 106 is in contact with a top surface of the arm 104. The eccentric cam 106 is coupled to a not-shown cam driving motor.

When the cam driving motor is rotated, the eccentric cam 106 rotates. With the rotation of the eccentric cam 106, the arm 104 swings around the axis B as a center. When the arm 104 swings around the axis B as a center, the external heating belt 80 is attached/detached to/from the peripheral surface of the heat roller 60. FIG. 3A shows a state a projection of the eccentric cam 106 is in the top dead center and the external heating belt 80 is in contact with the peripheral surface of the heat roller 60. FIG. 3B shows a state where the projection of the eccentric cam 106 is in the bottom dead center, and the external heating belt 80 is apart from the peripheral surface of the heat roller 60. The swing position of the eccentric cam 106 is detected by a not-shown cam position sensor. On the basis of a detection signal from the cam position sensor, the controller controls the rotation of the cam driving motor. The cam position sensor can be realized by, for example, giving a mark to a predetermined position in a side surface of the eccentric cam 106 and detecting the mark given by a reflecting type photosensor.

Control of Fusing Temperature

The controller controls the electric energy to turn on/off the heater lamp 61 in the heat roller 60 on the basis of the temperature detected by the thermister 62. The controller also controls the electric energy to turn on/off the heater lamp 71 in the pressure roller 70 on the basis of the temperature detected by the thermister 72. Further, the controller controls the electric energy to turn on/off the heater lamp 83 in the external heat roller 81 on the basis of the temperatures detected by the thermisters 62 and 85. The details are as follows.

(1) Temperature Control During Image Forming Process

During an image forming process, when the temperature detected by the thermister 62, that is, the surface temperature of the heat roller 60 reaches below the fusing control temperature, the controller turns on the heater lamp 61 and also turns on the heater lamp 83. In the case where the temperature detected by the thermister 85, that is, the surface temperature of the external heating belt 80 is higher than a predetermined temperature, the turn-off state of the heater lamp 83 is maintained. In such a manner, a temperature of the heating nip portion "n" is prevented from excessively rising and the heat roller is prevented from being damaged due to a high temperature. The predetermined temperature varies according to the printing modes. For example, in the case where the temperature detected by the thermister 85 is higher than 210° C. in the color printing mode or 220° C. in the monochrome printing mode, the controller performs control so as to continue the off state of the heater lamp 83.

The sheet conveyance speed in the monochrome printing mode is higher than that in the color printing mode. That is, the cycle of sheet conveyance in the monochrome printing mode is shorter than that in the color printing mode. Therefore, the amount of heat per unit time of the heat roller 60 taken by printing sheets in the monochrome printing mode is larger than that in the color printing mode. The amount of heat supplied to the external heating belt 80 in the monochrome printing mode has to be set to be larger than that in the color printing mode. According to the present invention, an upper limit temperature of the external heating belt 80 in the monochrome printing mode is set to be higher than that in the color printing mode. By the setting, a temperature difference between the upper limit temperature and the surface temperature of the heat roller 60 is increased, and a heat supply amount per unit time increases. Preferably, heating amounts of the heater lamps 61 and 83 are set so as to be balanced to an extent that the temperature detected by the thermister 85 reaches the upper limit temperature and the heater lamp 83 is turned off during the image forming process. The setting can be realized by conducting experiments at a designing stage and determining proper power consumption of each of the heater lamps.

When the temperature detected by the thermister 62 reaches higher than the fusing control temperature, the controller turns off the heater lamps 61 and 83.

Further, when the temperature detected by the thermister 72 reaches below the predetermined temperature (hereinbelow, called pressure roller control temperature), the controller turns on the heater lamp 71. When the temperature detected by the thermister 72 reaches higher than the predetermined temperature, the controller turns off the heater lamp 71.

(2) Temperature Control During Warm-up

During warm-up after turn-on of the power until the fuser unit enters a standby mode, the controller turns on the heater lamp 61 until the temperature detected by the thermister 62 reaches the fusing control temperature. The controller turns on the heater lamp 71 until the temperature detected by the thermister 72 reaches the pressure roller control temperature. The heater lamp 83 is set to be off to prevent a situation such that the temperature of the external heating belt 80 rises excessively due to the continuous heating and it damages the external heating belt 80.

When the external heating unit 75 has the attaching/detaching mechanism for making the external heating belt 80 attached/detached to/from the surface of the heat roller 60, the controller may operate the attaching/detaching mechanism so that the external heating belt 80 is detached from the surface of the heat roller 60 during the warm-up.

(3) Temperature Control in Standby Mode and Preheating Mode

In a standby mode of waiting for an instruction of image formation start after completion of the warm-up or after completion of the image formation, the controller turns on/off the heater lamp 61 so that the temperature detected by the thermister 62 maintains the fusing control temperature. The controller also turns on/off the heater lamp 71 so that the temperature detected by the thermister 72 maintains the pressure roller control temperature. The heater lamp 83 remains off.

In the case where the external heating unit 75 has the attaching/detaching mechanism, the controller may operate the attaching/detaching mechanism so that the external heating belt 80 is detached from the surface of the heat roller 60.

In the case where the standby mode continues for a predetermined period, the controller decreases a control temperature of the heat roller 60 so as to save the power in the standby mode. That is, the controller turns on/off the heater lamp 61 so that the temperature detected by the thermister 62 maintains a preheating temperature lower than the fusing control temperature.

(4) During Reset from Preheating Mode

In the case where an image formation start instruction is received during the precharging mode and the fuser unit is reset from the precharging mode, the controller turns on the heater lamps 61 and 83 until the temperature detected by the thermister 62 reaches the fusing control temperature. The reason why the heater lamp 83 is turned on in a manner different from the warm-up is to start image formation immediately after completion of the reset from the precharging mode.

When the external heating unit 75 has the attaching/detaching mechanism, the controller makes the attaching/detaching mechanism operate so that the external heating belt 80 comes into contact with the surface of the heat roller 60.

Figure 4:
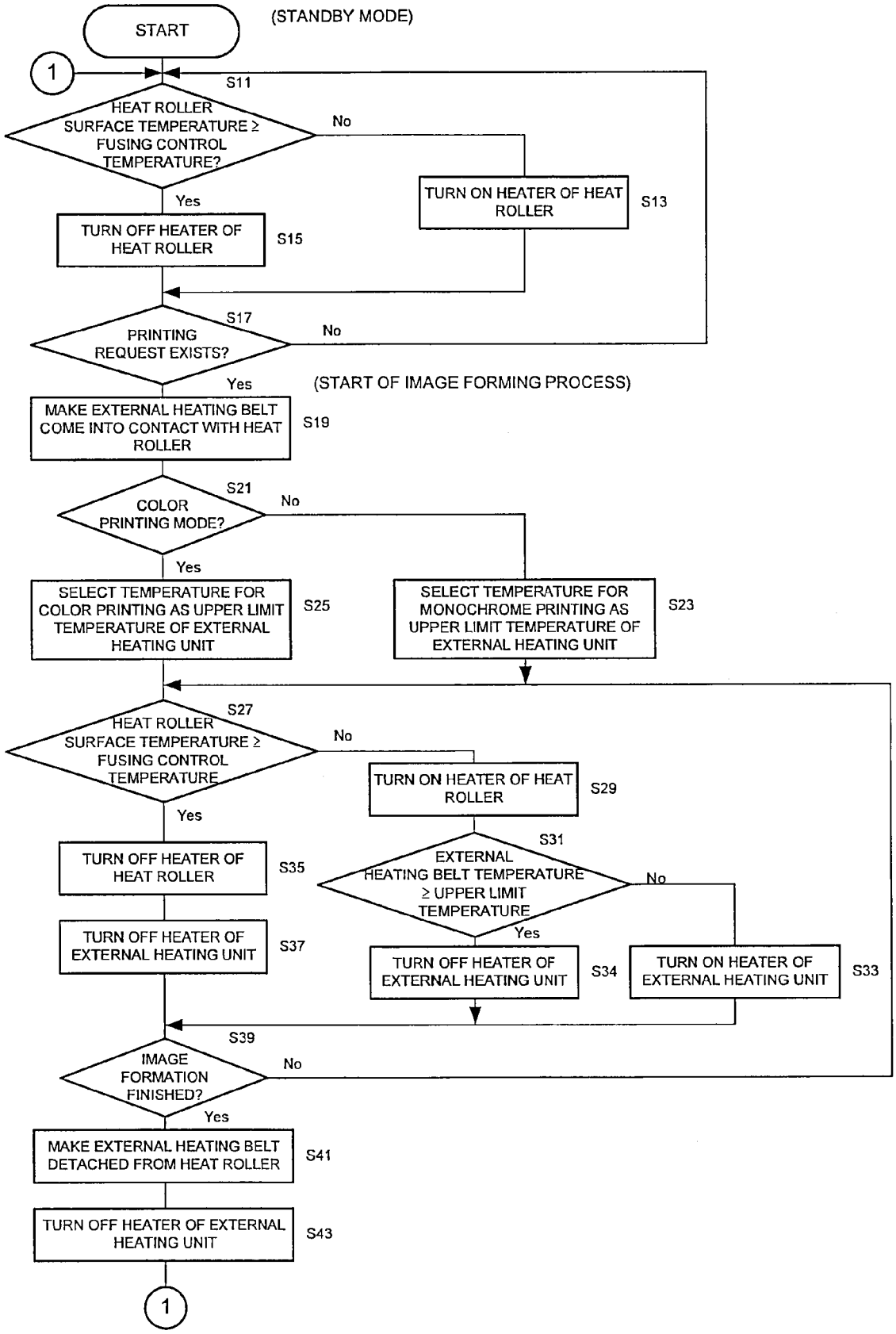
FIG. 4 is a flowchart showing the procedure of control for turning on/off heater lamps 61 and 83 in a standby state and during an image forming process in the fuser unit of the invention.

FIG. 4 is a flowchart showing the procedure of the control of turning on/off the heater lamps 61 and 83 in the standby mode and in the image forming process in the fuser unit of the invention. The processes in FIG. 4 are executed by the controller. The controller also controls the operations of the components in the image forming apparatus 1 such as turn-on/off of the heater lamp 71. The flowchart of FIG. 4 shows the procedure of extracting a task for controlling the heater lamps 61 and 83 from a plurality of tasks processed in a time sharing manner and executing the extracted task.

During the standby mode, the controller determines whether or not the surface temperature of the heat roller 60, that is, the temperature detected by the thermister 62 is equal to or higher than the fusing control temperature (step S11). When the detected temperature is less than the fusing control temperature, the controller turns on the heater lamp 61 in the heat roller (step S13). On the other hand, when the detected temperature is equal to or higher than the fusing control temperature, the controller turns off the heater lamp 61 (step S15). The controller determines whether there is a printing request or not (step S17). If there is no printing request, the routine returns to the step S11 and the control of turning on/off the heater lamp 61 is repeated.

When there is a printing request, the controller controls the operations of the components in the image forming apparatus 1 to start the image forming process. With respect to the control on the heat roller 60 and the external heating unit 75, first, to make the external heating belt 80 come into contact with the heat roller 60, the cam driving motor is driven (step S19).

Next, the controller determines whether a printing mode to be executed is the color printing mode or the monochrome printing mode (step S21). In the case where the printing mode is the monochrome printing mode, the controller selects a temperature for the monochrome printing as an upper limit temperature of the external heating unit (step S23). In the embodiment, the temperature for the monochrome printing is 220° C. In the case where the printing mode is the color printing mode, the controller selects a temperature for the color printing as the upper limit temperature of the external heating unit (step S25). In the embodiment, the temperature for the color printing is 210° C.

Subsequently, the controller determines whether or not the surface temperature of the heat roller 60 is equal to or higher than the fusing control temperature (step S27). In the case where the detected temperature is less than the fusing control temperature, the controller turns on the heater lamp 61 in the heat roller (step S29). Further, the controller determines whether or not the surface temperature of the external heating belt 80, that is, the temperature detected by the thermister 85 is equal to or higher than the upper limit temperature (step S31). In the case where a surface temperature of the external heating unit is less than the upper limit temperature, the controller turns on the heater lamp 83 in the external heating unit (step S33). After that, the routine advances to step S39. On the other hand, in the case where the surface temperature of the external heating unit is equal to or higher than the upper limit temperature, the controller turns off the heater lamp 83 (step S34). After that, the routine advances to step S39.

In the case where the detected temperature is equal to or higher than the fusing control temperature in the step S27, the controller turns off the heater lamp 61 (step S35) and, further, turns off the heater lamp 83 (step S37). After that, the routine advances to step S39.

In step S39, the controller determines whether the image forming process is finished or not. When the image forming process has not been completed yet, the routine advances to step S27 and the subsequent processes are repeated. On the other hand, when the image forming process has been finished, the controller performs a process for resetting the fuser unit to the standby mode. Specifically, the controller drives the cam driving motor to make the external heating belt 80 detached from the surface of the heat roller 60 (step S41). Further, the controller turns off the heater lamp 83 in the external heating unit 75 (step S43). After that, the routine advances to step S11 and performs the process in the standby mode.

Figure 5:
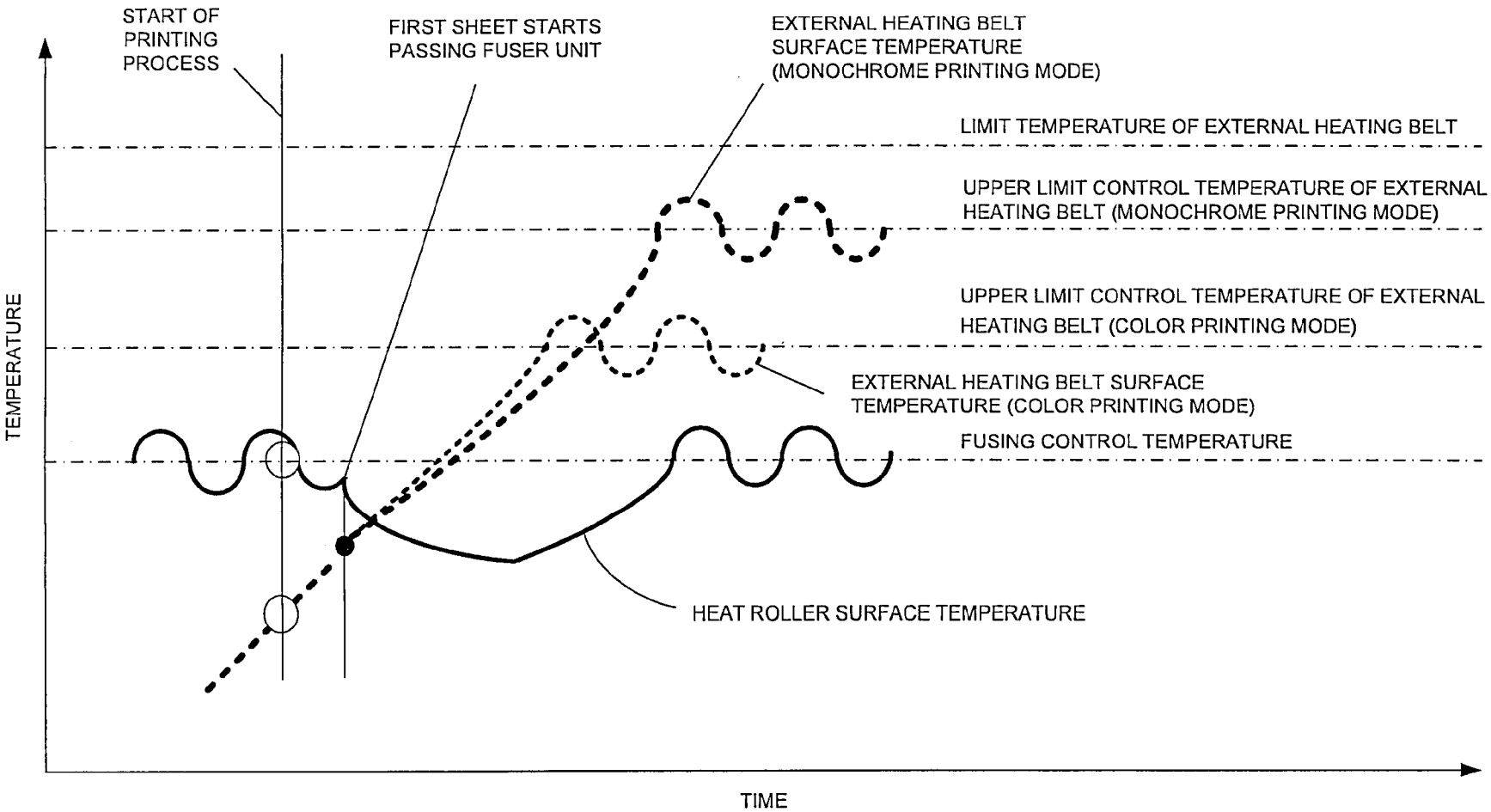
FIG. 5 is a graph showing an example of transition of detected temperatures of thermisters 62 and 85 in the standby state and during the image forming process in the case where the temperature control shown in FIG. 4 is executed.

FIG. 5 is a graph showing an example of transition of the temperatures detected by the thermisters 62 and 85 in the standby mode and in the image process in the case where the temperature control shown in FIG. 4 is performed.

After start of the image forming process, due to passage of sheets in the fusing part, the surface temperature of the heat roller 60 drops. According to the drop in the surface temperature, the heater lamp 61 in the heat roller 60 and the heater lamp 83 in the external heating unit 75 are turned on. There is a time lag until heat from the inside of the heat roller 60 is transferred to a surface of the elastic layer. During the time lag, heat is supplied from the external heating belt 80 to the surface of the heat roller 60. Therefore, as compared with a fuser unit having no external heating belt 80, the degree of drop in the surface temperature of the heat roller 60 after start of the image forming process is suppressed.

In the monochrome printing mode, the number of sheets passing per unit time is larger than that in the color printing mode. Therefore, drop in the surface temperature is faster. However, since the upper limit temperature of the external heating belt 80 is set to be higher than that in the color printing mode, a temperature transition in the external heating belt 80 is higher than that in the color printing mode. Consequently, an amount of a heat supply to the heat roller 60 is larger than that in the color printing mode. As a result, a temperature in the minimum point of the surface temperature remains about the same as that in the color printing mode.

Configuration of Image Forming Apparatus

Figure 2:
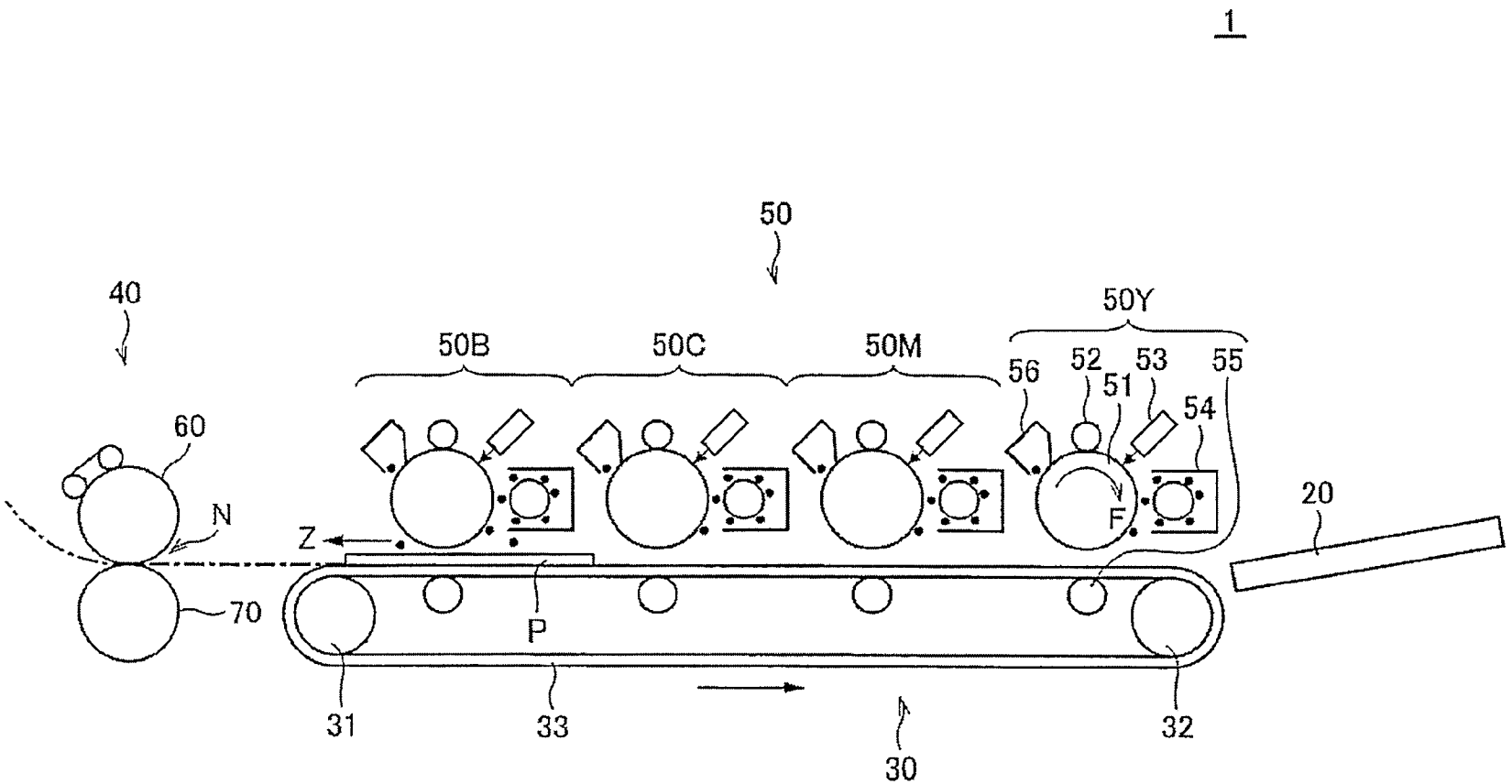
FIG. 2 is a diagram schematically showing an internal structure of an image forming apparatus according to the invention.

Referring to FIG. 2, the image forming apparatus having the fuser unit of the embodiment will be described. FIG. 2 is a diagram schematically showing the internal structure of the image forming apparatus according to the present invention.

The image forming apparatus 1 shown in FIG. 2 forms a color image or monochrome image on the sheet P on the basis of image data. The image data is transmitted via a network or read by a scanner. In the embodiment, an electrophotographic 4-drum-tandem color printer will be described as an example.

The image forming apparatus 1 has a visible image forming unit 50, a sheet conveyer 30, the fuser unit 40, and a sheet feeding tray 20.

The visible image forming unit 50 is constructed by a yellow visible image forming unit 50Y, a magenta visible image forming unit 50M, a cyan visible image forming unit 50C, and a black visible image forming unit 50B. As concrete arrangement, between the sheet feeding tray 20 and the fuser unit 40, the yellow visible image forming unit 50Y, the magenta visible image forming unit 50M, the cyan visible image forming unit 50C, and the black visible image forming unit 50B are provided in order from the sheet feeding tray 20 side.

The visible image forming units 50Y, 50M, 50C, and 50B have substantially the same configuration, form a yellow image, a magenta image, a cyan image, and a black image, respectively, and transfer the images onto the sheet P conveyed on the conveyance belt 33 which will be described later.

Each of the visible image forming units 50Y, 50M, 50C, and 50B has a photoconductor drum 51. Around the photoconductor drum 51, along the rotation direction (the direction of the arrow F) of the photoconductor drum 51, a charging roller 52, an exposure unit 53, a developing unit 54, a transfer roller 55, and a cleaning device 56 are disposed.

The photoconductor drum 51 has a photosensitive material layer on its surface, and rotates in the direction of the arrow F. The charging roller 52 is a charger for uniformly charging a surface of the photoconductor drum 51.

The exposure unit 53 exposes the surface of the charged photoconductor drum 51 on the basis of an input image signal, thereby generating an electrostatic latent image. An example of the exposure unit 53 is an LED array. Alternatively, a laser beam scanner unit for performing a deflection scan by making a laser beam reflected by a polygon mirror may be used. In the color printing mode, to the exposure units 53 of the visible image forming units 50Y, 50M, 50C, and 50B, pixel data corresponding to the color components of yellow, magenta, cyan, and black is input. Therefore, on the photoconductor drums 51, electrostatic latent images corresponding to the color components of yellow, magenta, cyan, and black are formed. On the other hand, in the monochrome printing mode, pixel data corresponding to the black component is input only to the exposure unit 53 of the visible image forming unit 50B. No image data is input to the exposure units for yellow, magenta, and cyan. Therefore, an electrostatic latent image is formed only on the photoconductor drum 51 for black. No electrostatic latent images are not formed on the photoconductor drums 51 for yellow, magenta, and cyan.

The developing unit 54 develops the electrostatic latent image formed on the surface of the photoconductor drum 51 with a developer containing toner, thereby forming a toner image (active image). The developing units 54 of the visible image forming units 50Y, 50M, 50C, and 50B form toner images by using developers for yellow, magenta, cyan, and black, respectively. In the color printing mode, electrostatic latent images of yellow, magenta, cyan, and black are formed and toner images of the color components are formed. In the monochrome printing mode, only a black toner image is formed. Since electrostatic latent images are not formed for the color components of yellow, magenta, and cyan, toner images of the color components are not formed. Developers (also called toners hereinbelow) which are used include a non-magnetic single-component developer (non-magnetic toner), a non-magnetic two-component developer (non-magnetic toner and carrier), and a magnetic developer (magnetic toner).

The transfer rollers 55 are disposed on the back side of the conveyance belt 33 which will be described later to transfer a toner image on the photoconductor drum 51 onto the sheet P conveyed by the conveyance belt 33. To the transfer roller 55, a bias voltage having the polarity opposite to that of toner with respect to the ground potential can be applied. By applying the bias voltage to the transfer roller 55 at the timing the sheet P passes through the transfer roller 55, the toner image on the photoconductor drum 51 is transferred onto the sheet P.

The cleaning device 56 is provided to remove toner residing on the photoconductor drum 51 after transfer of the image onto the sheet P.

The sheet conveyer 30 is constructed by the conveyance belt 33, and a drive roller 31 and an idling roller 32 over which the conveyance belt 33 is looped. The sheet conveyer 30 sucks and holds the sheet P sent from the sheet feeding tray 20 by the conveyance belt 33, and conveys the sheet P so that the toner images formed by the visible image forming units 50Y, 50M, 50C, and 50B are sequentially transferred onto the sheet P. By the rotation of the drive roller 31, the conveyance belt 33 turns at predetermined circumferential speed.

In the embodiment, the circumferential speed of the conveyance belt 33 is 225 mm/second in the color printing mode and is 350 mm/second in the monochrome printing mode. The sheet P on which the toner images are transferred is separated from the conveyance belt 33 by the curvature of the drive roller 31 and conveyed to the fuser unit 40 (the arrow Z shows the conveyance direction and the alternate long and short dash line show the conveyance path).

The fuser unit 40 has the heat roller 60 and the pressure roller 70 which are in pressure-contact with each other. One of the heat roller and the pressure roller 70 is heated. By passing the sheet P on which an unset toner image is transferred through the nip portion N as the pressure contact part, the toner image is thermally fixed on the sheet P. The details of the fuser unit 40 are as described above.

The sheet P on which the toner image is formed by the fuser unit 40 is ejected to an ejection tray (not shown) on the outside of the image forming apparatus 1, and the image forming process is finished.

In the image forming apparatus 1, the controller for performing the operation controls on the components and performing an image process on the image data is mounted. The controller is a microcomputer including at least a CPU and a RAM and executes the operation control and the image process in accordance with a control program pre-recorded on a not-shown nonvolatile memory device such as a flash ROM.

Finally, it is obvious that the present invention is not limited to the foregoing embodiment but can be variously modified. It is to be considered that such modifications belong to the characteristics and the scope of the invention. All changes that fall within the meaning and range of equivalency of the claims are intended to be embraced by the claims of the invention.

What is claimed is:

1. A fuser unit for an image forming apparatus in which printing is performed selectively in either a monochrome printing mode or a color printing mode and the number of sheets conveyed per unit time in the monochrome printing mode is larger than the number of sheets conveyed per unit time in the color printing mode, comprising:

a set of a heat roller and a pressure roller for sandwiching and conveying a printing sheet while heating the printing sheet by the heat roller;

a peripheral surface contact member which is in contact with the peripheral surface of the heat roller;

an external heater for heating the peripheral surface contact member by applying electric energy;

a contact member temperature sensor for detecting a temperature of the peripheral surface contact member; and a temperature controller for controlling an upper limit temperature of the peripheral surface contact member in accordance with the number of printing sheets conveyed per unit time;

wherein the upper limit temperature of the peripheral surface contact member in the monochrome printing mode is set to be higher than the upper limit temperature of the peripheral surface contact member in the color printing mode.

2. The fuser unit according to claim 1, wherein the peripheral surface contact member includes a plurality of rollers and an endless belt looped over the rollers, and the endless belt is disposed so that a portion between the rollers is in contact with the heat roller.

3. The fuser unit according to claim 2, wherein the external heater heats the roller positioned on the upstream side from the portion of the endless belt in contact with the heat roller to supply heat via the heated roller to a surface of the endless belt.

4. The fuser unit according to claim 2, wherein the contact member temperature sensor detects a surface temperature of the endless belt.

5. The fuser unit according to claim 2, wherein the contact member temperature sensor is disposed to abut on the endless belt around the peripheral surface of the roller heated by the external heater.

6. An image forming apparatus comprising the fuser unit according to claim 1.

7. The image forming apparatus according to claim 6, further comprising:

an internal heater disposed in the heat roller; and a fusing temperature sensor for detecting a surface temperature of the heat roller, wherein the temperature controller further controls electric energy applied to the internal heater so that a temperature detected by the fusing temperature sensor is set at a predetermined fusing control temperature.

8. The image forming apparatus according to claim 7, wherein the fusing control temperature in the color printing mode and that in the monochrome printing mode are equal to each other.

9. The image forming apparatus according to claim 7, wherein the fusing control temperature is lower than the upper limit temperature in the monochrome printing mode and is also lower than the upper limit temperature in the color printing mode.

* * * * *